United States Patent [19]

Hagan

[11] Patent Number: 4,955,092

[45] Date of Patent: Sep. 11, 1990

[54] SWIMMING POOL COVER

[76] Inventor: Thomas F. Hagan, 85-66 - 6th Ave., Rego Park, N.Y. 11374

[21] Appl. No.: 437,111

[22] Filed: Nov. 16, 1989

[51] Int. Cl.[5] ..... E04H 3/19

[52] U.S. Cl. ..... 4/502; 4/504; 242/86.52

[58] Field of Search ..... 4/502, 504; 242/86.52

[56] References Cited

U.S. PATENT DOCUMENTS

| | | | |
|---|---|---|---|
| 2,958,083 | 11/1960 | Shook et al. | 4/502 |
| 3,916,457 | 11/1975 | Morita | 4/502 |
| 4,203,174 | 5/1980 | Shults | 4/502 |
| 4,411,031 | 10/1983 | Stolar | 4/502 |
| 4,494,256 | 1/1985 | Radtke et al. | 4/502 |
| 4,632,329 | 12/1986 | Burley | 242/86.52 |
| 4,686,717 | 8/1987 | MacDonald | 4/502 |
| 4,747,168 | 5/1988 | Sing | 4/504 |

*Primary Examiner*—Charles E. Phillips

[57] ABSTRACT

A cover for a swimming pool. Cables attached to edge area of the cover move within tracks extending along the pool side walls, such that the cover can be moved to a fully opened condition or to a fully closed condition spanning the length of the pool. Electric motors are the preferred mechanism for moving the cables and associated pool cover. The control circuitry for the motors preferably includes a safety device that prevents the cover from being closed against a person or object in the pool. Should the leading edge of the cover strike a person or object in the pool the cover will immediately retract to a fully opened condition.

2 Claims, 1 Drawing Sheet

SWIMMING POOL COVER

BACKGROUND AND SUMMARY OF THE INVENTION

This invention relates to a cover structure for a swimming pool. The cover structure can be formed of an open weave net material, in which case the cover serves primarily as a safety device to prevent persons from falling into the pool. Alternately, the cover structure could be formed of a non-porous fabric or flexible sheet material, in which case the cover could in addition serve as protection against leaves or other debris from entering the pool. The cover could also serve to minimize water evaporation losses, as well as maximizing the solar heating action obtained with some cover materials. The term "cover" will be used herein to designate either a non-porous flexible sheet-like cover or a porous open weave net-like cover.

A principle aim of the invention is to provide a cover that can be opened or closed with a relatively small energy expenditure. In its preferred form the cover is attached to two laterally spaced cables running within tracks along opposite sides of the swimming pool. Cable motion in one direction draws the cover across the pool opening to a closed position. Cable motion in the other direction draws the cover to an open position. Comparatively little effort is required to move the cable back and forth.

Electric motors may be used to open or close the cover. Alternately, the cover may be opened or closed by the use of rotary hand cranks. When electric motors are used, such motors may be remotely controlled with radio signal sending-receiving equipment. Preferably the power supply for such equipment includes a key-operated switch, such that the pool owner is assured that the cover will not be operated unless the owner is present. In addition there is a stationary hard wired open/close switch that is also activated by the master key switch.

In preferred practice of the invention a safety device is associated with the leading edge of the cover, so that if a person (or object) should be touched thereby while the cover is being closed the safety mechanism would automatically cause the cover to retract to the open position, thereby preventing a person or object from being trapped against or underneath the cover.

THE DRAWINGS

DESCRIPTION OF A PREFERRED EMBODIMENT OF THE INVENTION

Figure 1:
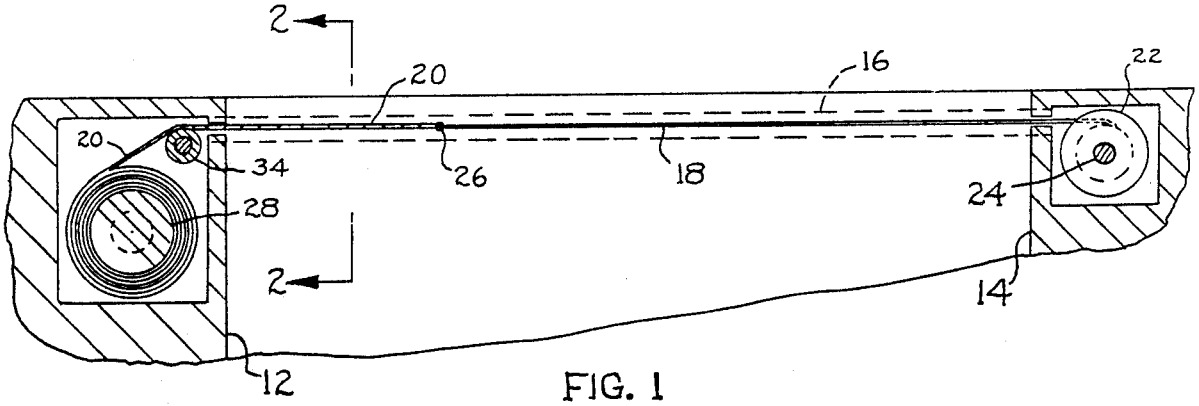
FIG. 1 is a sectional view taken through a swimming pool equipped with a cover structure embodying the invention.
Figure 2:
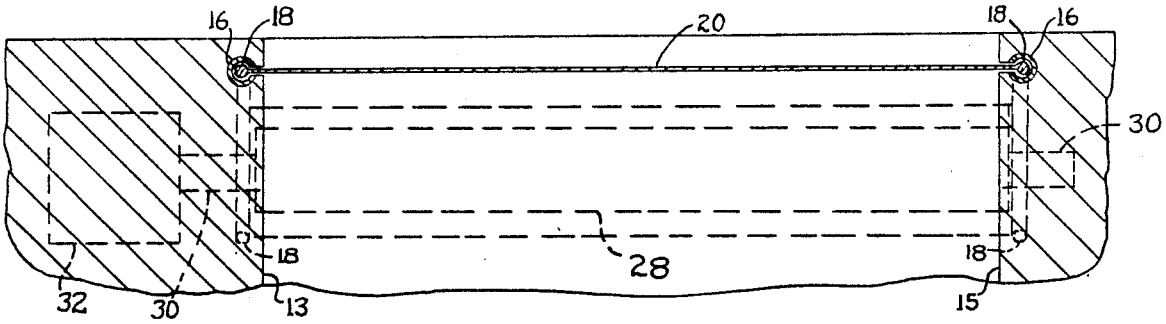
FIG. 2 is a transverse sectional view taken on line 2—2 in FIG. 1.

FIG. 1 fragmentarily illustrates a swimming pool having end walls 12 and 14. The connecting pool side walls 13 and 15 have parallel horizontal tracks 16 running therealong. FIG. 2 shows the track cross section as circular, although other cross sections can be used.

Each track 16 has a flexible cable (cord) 18 extending therewithin. A flexible cover 20 is attached to the two cables to span the space between the pool side walls 13 and 15. One end of each cable 18 is connected to a pulley 22 located beyond pool end wall 14; there are two pulleys (one for each cable) mounted on a single shaft 24. An electric motor is operatively connected to shaft 24 to rotate the shaft in a clockwise direction (FIG. 1), thereby rotating the two pulleys for thus drawing the associated cover 20 to a closed position fully covering the space between end walls 12 and 14.

The rightmost edge of cover 20 is defined by a cable 26 that extends transversely between the two cables 18. FIG. 1 shows cover 20 in a partially open condition wherein cable 26 is located between walls 12 and 14. In the fully closed position of cover 20 cable 26 will be near wall 14. In the fully open position of cover 20 cable 26 will be at wall 12.

Cover 20 is wound onto (around) a drum 28 that has shafts 30 at its ends supported in suitable bearings. An electric motor 32 is operatively connected to one of the shafts 30 for rotating the drum in a counterclockwise direction (FIG. 1), thereby moving cover 20 to an open condition. A transversely extending roller 34 can be located above drum 28 to guide and support the cover as it is being wound onto the drum (or as it is being unwound from the drum). The drum and associated roller 34 can be slightly shorter than the spacing between tracks 16, such that cables 18 will be beyond the ends of the drum when the associated cover is wound onto the drum.

It will be understood that the motors associated with pulleys 22 and drum 28 will be operated at different times. The motors are preferably operated in at least two different ways in order to provide flexibility, while at the same time assuring the pool owner that the cover is not being operated in an unsafe manner. In one mode of operation the motors are operated by actuation of manually-operated switches. In a second operational mode the motors are operated by a remotely-controlled radio sending-receiving system.

Figure 3:
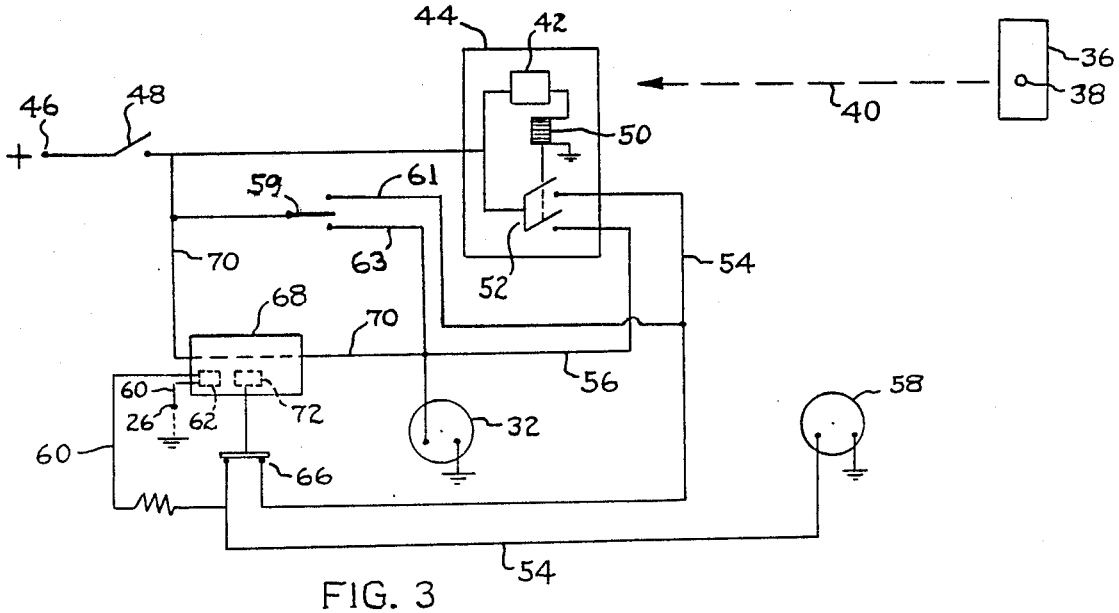
FIG. 3 is a circuit diagram for an electrical system that can be used to open or close the cover shown in FIGS. 1 and 2.

As shown in FIG. 3, current source 46 is connected to a master switch 48 that is preferably key-controlled. The key-controlled switch enables the pool owner to completely de-energize the system when he is away from the premises or does not wish the cover to be uncovered (or covered) for any reason.

The cover can be operated to the closed position by an electric motor 58; the cover can be operated to the open position by an electric motor 32. For manual operation of the motors there is provided a key-operated switch 59 having three positions. In its illustrated position switch 59 is in a circuit-open condition. When the key is turned in one direction the switch is caused to deliver current to a line 61 that connects with line 54; line 54 supplies current to motor 58. When the key is turned in the other direction switch 59 will deliver current to a line 53 that supplies current to motor 32.

In a second operational mode the motors can be operated by a remotely-controlled radio sending-receiving system shown diagrammatically in FIG. 3. The system includes a hand-held radio signal unit 36 having a push button actuator 38. Manual depression of button 38 causes a radio signal 40 to be sent toward a receiver 42 mounted in a housing 44 located in near adjacency to the swimming pool. Sending unit 36 can be remote from the pool, i.e. within the home where the pool is located.

Sending unit 36 can be battery-operated. Receiving unit 42 can be located in a D.C. circuit that includes a positive source 46 and the previously mentioned key-controlled switch 48. Switch 48 enables the owner to completely de-energize the circuit when he is away from the premises or does not wish the cover to be uncovered for any reason, e.g. during the night time.

Receiving unit 42, when energized by radio signal 40, delivers current to a relay coil 50 that operates a push-pull switch mechanism 52. This switch mechanism is of the type wherein successive actuations of coil 50 cause current to be delivered alternately to line 54, then to line 56, then to line 54, etc. Switch mechanism 52 can include a rotary ratchet structure.

Line 54 leads to an electric motor 58. Line 56 leads to an electric motor 32. Motor 58 will be connected to pulley shaft 24 (FIG. 2) for closing the pool cover. Motor 32 will be connected to drum 28 for opening the pool cover. The system is such that when the pool owner, or authorized user, depresses push button 38 one of the motors will be energized. As long as button 38 is held in a depressed condition one of the motors will remain energized. When button 38 is released the motor will stop. On the next depression of button 38 the other motor will operate; it will continue to operate as long as the push button is held down (until the cover is fully opened or fully closed).

Limit switches (not shown) will be arranged in the path of cover 20 to automatically de-energize the associated motor when the cover reaches the closed or open position.

As a safety measure, there is provided a motor-switching circuit that comes into play when a person or object is in the pool in the path of cover 20 during the cover-closing process. The circuit is intended to automatically switch motor 58 off and switch motor 32 on, when cable 26 (at the leading edge of the cover) comes into contact with a person or object in the pool. The cover is automatically retracted to the open position thereby preventing a person from inadvertently becoming trapped underneath the cover or otherwise being pushed under water or against end wall 14.

Cable 26 will include a current conductor extending therealong for the full width of the pool, i.e. the space between walls 13 and 15. A small current (non-harmful to humans) will be supplied to the current conductor when motor 58 is energized to close the cover. As shown in FIG. 3, the small current is directed from line 54 through line 60 to a relay coil 62, thence to the conductor in cable 26. Any human or object touching cable 26 will complete the circuit, thereby energizing coil 62. Line 60 will extend along and within one of the cables 18 (FIGS. 1 and 2).

Numeral 68 references a timer that includes an interruptable circuit 70 leading from positive source 46 to motor 32. When coil 62 is energized it will trigger circuit 70 closed for a sufficient time period to fully retract the pool cover to an open condition. Coil 62 needs to be energized only momentarily to start the timer running; the timer will continue to run even though the person or object in the pool moves out of contact with the conductor in cable 26. Motor 32 will run until it is shut down by the associated limit switch.

Timer 68 supplies current to a relay coil 72 that controls a set of contacts 66 in line 54. As long as circuit 70 is supplying current to motor 32 contacts 66 will be open, thereby preventing motor 58 from running. It should be understood that timer 68 and the associated line 70 become active only when motor 58 is attempting to close the pool cover and a person or object is in the path of the leading edge 26 of the cover; in such a situation the timer energizes line 70 and simultaneously opens contacts 66 leading to motor 58. Under normal circumstances contacts 66 are closed; motor 32 is energized through line 56, whereas motor 58 is energized through line 54 (via switch 59 or the radio signal from sender 36).

Tracks 16 will be parallel with one another. In many cases tracks 16 will parallel the pool side walls 13 and 15. However, the pool can have an irregular shape, e.g. oval or round, in which case the pool side walls will have variable spacings from the tracks. The pool cover 20 will extend into horizontal slots in the pool side walls. Alternately the slots can be formed in the pool deck. Cables 18 will run along edge areas of cover 20 for its full length. Various types of anti-friction devices, e.g. rollers, slides or guides, can be located on cables 18 or tracks 16 to minimize frictional drag between the cables and the tracks.

I claim:

1. A flexible cover structure for a swimming pool comprising two parallel horizontal tracks extending along opposite sides of a swimming pool; a flexible cable running within each track; a flexible cover extending across the space between the cables; a rotary drum at one end of the pool; two spaced pulleys at the other end of the pool; said cables extending within the tracks and around the pulleys; said flexible cover having one end thereof wrapped around the drum, and the other end thereof movable between opposite ends of the pool, a first cover-opener motor at said one end of the pool for operating said drum, and a second cover-closer motor at the other end of the pool for operating the spaced pulleys, a safety device incorporated into said other end of the flexible cover comprising an electrical carrying cable extending across said other end and carrying an electrical current not harmful to humans, for responding to physical engagement between a person or object and said other end of the cover when said second motor is in the process of closing the cover, said safety device including appropriate circuitry to convey said current to said cable and to respond to said engagement by stopping said second motor and starting said first motor.

2. The cover structure of claim 1, and further comprising a master key-operated switch (48) and two control systems connected to said master switch for selectively operating said motors; one of said control systems comprising a manual switch (59) having one contact connected to the first motor and a second contact connected to the second motor; the other control system being a remotely-controlled system for operating said motors; said remotely-controlled system comprising a battery-powered radio sending unit having a push button operator, a radio receiver unit located at the swimming pool, and a relay controlled by said receiver unit.

* * * * *

UNITED STATES PATENT AND TRADEMARK OFFICE

CERTIFICATE OF CORRECTION

PATENT NO. : 4,955,092

DATED : September 11, 1990

INVENTOR(S) : Hagan

It is certified that error appears in the above-identified patent and that said Letters Patent is hereby corrected as shown below:

Title page, item [76]: Inventor's address should be corrected to read

--85-66 67th Avenue
Rego Park, N.Y. 11374--.

Signed and Sealed this

Twenty-eighth Day of May, 1991

*Attest:*

HARRY F. MANBECK, JR.

*Attesting Officer*

*Commissioner of Patents and Trademarks*